US006918415B1

(12) United States Patent
Johnson

(10) Patent No.: US 6,918,415 B1
(45) Date of Patent: Jul. 19, 2005

(54) PERSONAL FUEL HOSE LIFT

(76) Inventor: Bruce Johnson, P.O. Box 24743, Federal Way, WA (US) 98093

( * ) Notice: Subject to any disclaimer, the term of this patent is extended or adjusted under 35 U.S.C. 154(b) by 0 days.

(21) Appl. No.: 10/806,796

(22) Filed: Mar. 23, 2004

Related U.S. Application Data

(60) Provisional application No. 60/535,663, filed on Jan. 9, 2004.

(51) Int. Cl.[7] ..... B65B 1/04

(52) U.S. Cl. ..... 141/1; 141/98; 141/231; 222/526; 248/75; 294/16

(58) Field of Search ..... 141/1, 98, 231, 141/391; 222/526; 294/16, 81.54; 248/75, 248/76, 313

(56) References Cited

U.S. PATENT DOCUMENTS 57,886 A * 9/1866 Frentz ..... 248/78
251,996 A * 1/1882 Callahan ..... 248/78
297,788 A * 4/1884 Green ..... 294/16
1,829,621 A * 10/1931 Whiteford ..... 239/276
4,838,465 A * 6/1989 Metzger ..... 222/526

* cited by examiner

*Primary Examiner*—Timothy L. Maust
(74) *Attorney, Agent, or Firm*—David L. Tingey

(57) ABSTRACT

A lift as a personal tool used manually to lift portions of a fuel hose successively, equipped to slide along the fuel hose as a user walks erect as the user moves along the fuel hose progressively causing residual fuel in the fuel hose to drain out the hose distal end, away from the fuel truck. The lift includes a handle adapted for grasping by its user separated from a fuel hose support by a bar depending from the handle forming a C-shape with an open portion opposite the bar and a trough opposite the handle. A roller disposed to roll on the hose support has a radially extending flange on each roller end maintaining the fuel hose central on the roller. In use, the user walks in erect posture from the truck along the fuel hose with the lift hanging from the user's downwardly extending arm. As the hose leads to the ground and before the hose reaches the ground, the hose moves into the lift trough engaging the hose at a hose engagement level several inches above the ground. As the user continues to walk slowly along the hose, the lift lifts the fuel hose in successive portions along the fuel hose progressively urging fuel in the hose to move forward of the lift by gravity while hose portions rearward of the lift, that is, toward the truck, fall to the ground empty of fuel.

11 Claims, 2 Drawing Sheets

PERSONAL FUEL HOSE LIFT

I claim benefit from that provisional patent application filed under Ser. No. 60/535,663 on Jan. 9, 2004.

BACKGROUND

1. Field of the Invention

This invention relates to devices for draining fuel hoses typically used to deliver fuel from tanker trucks to an underground storage tank, and specifically to a personal tool that lifts the fuel hose in successive portions to progressively drain fuel out of the line distal end at the storage tank.

2. Prior Art

Motor vehicle fuel is generally stored in underground storage tanks at vehicle service stations and pumped from the storage tanks to vehicles on demand. The storage tanks are replenished from time to time from tanker trucks that deliver the fuel to the service stations. A semi-rigid, reinforced fuel hose is connected at its distal to a tanker truck valve above ground level. The fuel hose distal end is then routed to a ground level port at the storage tank. When the truck valve is opened, fuel runs by gravity in the fuel hose from the truck tank to the storage tank. When the fuel is delivered, the truck tank valve is closed and most of the fuel in the fuel hose continues to the storage tank. However, a residual portion of the fuel typically remains in the fuel hose.

The fuel hose cannot be stored on the truck with fuel in it and fuel spills from the hose are environmentally hazardous so the fuel is drained by manually lifting successive portions of the hose from the hose proximal end at the truck as the operator walks along the fuel hose to the fuel distal end. As the fuel hose portion is lifted, fuel in that portion drains outward toward the fuel hose distal end. The fuel hose is typically heavy so the operator lifts the fuel hose only slightly from the ground, just enough to allow gravity to move the residual fuel within along the fuel hose. This entails the operator bending over as he lifts and walks along the fuel hose.

This fuel hose lifting maneuver is debilitating to the operator over time. Reported statistics show that twenty-five percent of truck drivers claims for injury were because of their backs and the injury was sixty-eight percent more costly when the injury occurred during fuel delivery. Twenty-one percent of driver injuries were due to lifting.

The primary object of this invention is to provide a personal tool, or lift, that a truck operator can use to lift the fuel hose in portions while the driver walks along the fuel hose in normal erect posture rather than bending over. It is another object that the lift slide or roll along the fuel hose easily. It is a further object that the lift retain the fuel hose within the tool during use. It still another object that the tool receive the fuel hose intermediate its length rather than requiring that an end of the fuel hose be inserted through the tool.

SUMMARY

These objects are achieved in a lift as a personal tool used manually to lift portions of a fuel hose successively, equipped to slide along the fuel hose as a user walks erect as the user moves along the fuel hose progressively causing residual fuel in the hose to drain out the hose distal end, away from the fuel truck.

The lift includes a handle adapted for grasping by its user separated from a fuel hose support by a bar depending from a handle first end. Typically, the handle and hose support are horizontal and parallel and the bar is vertical between them, connecting between them on bar upper and lower ends, respectively, forming a C-shape with an open portion opposite the bar and a trough opposite the handle. A roller disposed to roll on the hose support has a radially extending flange on each roller end maintaining the fuel hose central on the roller.

In practice, the user places the lift over the hose, the hose entering the lift through the lift open portion near the truck at the truck tank valve. As the user grasps the handle the lift moves vertical of its own weight. The user then walks in erect posture from the truck along the fuel hose with the lift hanging from the user's downwardly extending arm. As the hose leads to the ground and before the hose reaches the ground, the hose moves into the lift trough engaging the hose at a hose engagement level several inches above the ground. As the user continues to walk slowly along the hose, the lift lifts the fuel hose progressively along the fuel hose urging fuel in the hose to move forward of the lift by gravity while hose portions rearward of the lift, that is, toward the truck, fall to the ground empty of fuel.

DETAILED DESCRIPTION OF THE PREFERRED EMBODIMENTS

Figure 1:
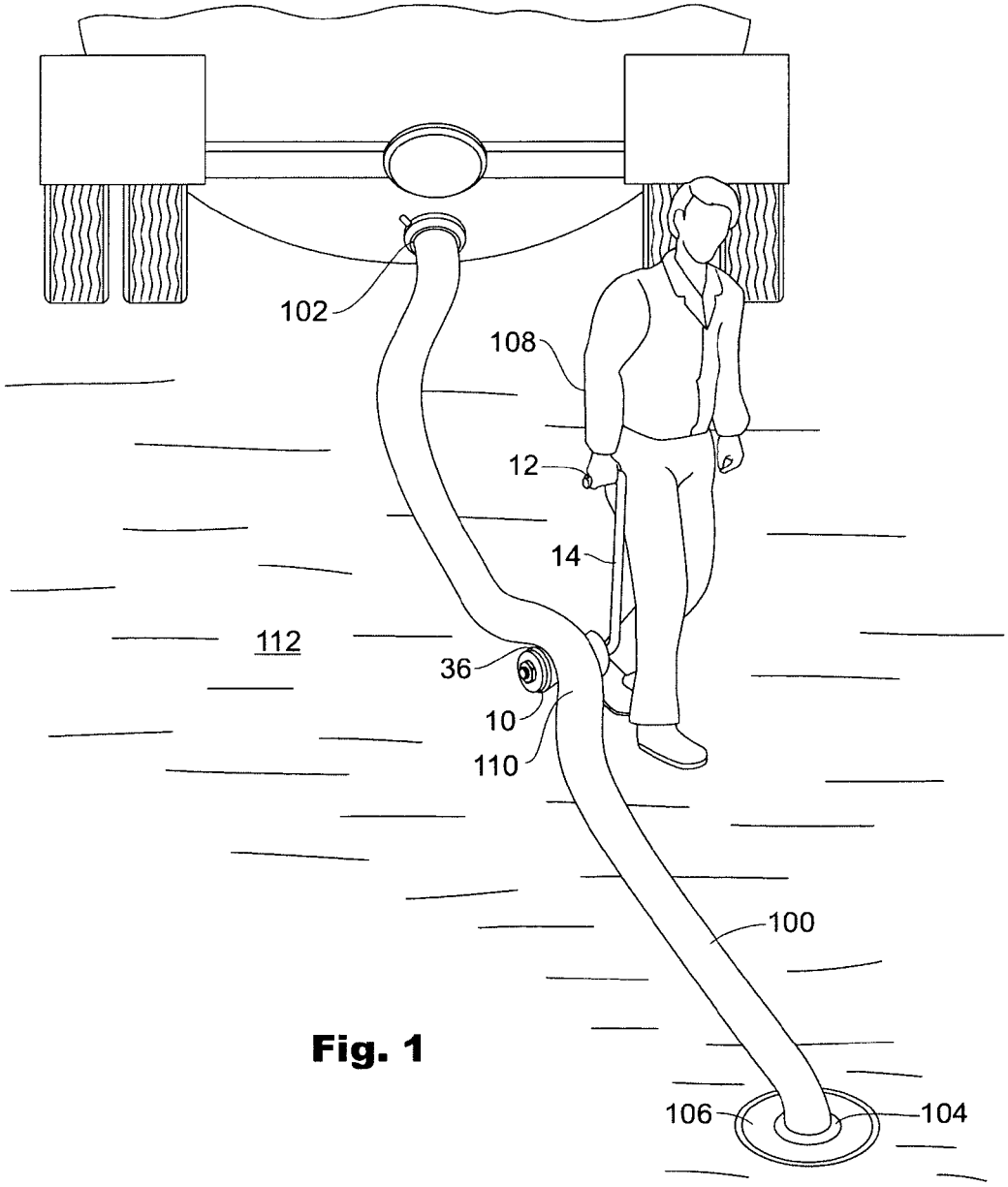
FIG. 1 is an artistic view of a person employing the lift to drain residual fuel from a fuel hose attached to a delivery tanker truck.
Figure 2:
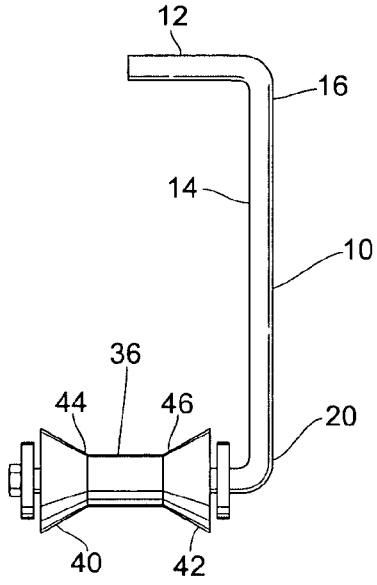
FIG. 2 is a side view of the personal fuel hose lift of the present invention showing a roller on a fuel line support spaced apart from a handle.
Figure 3:
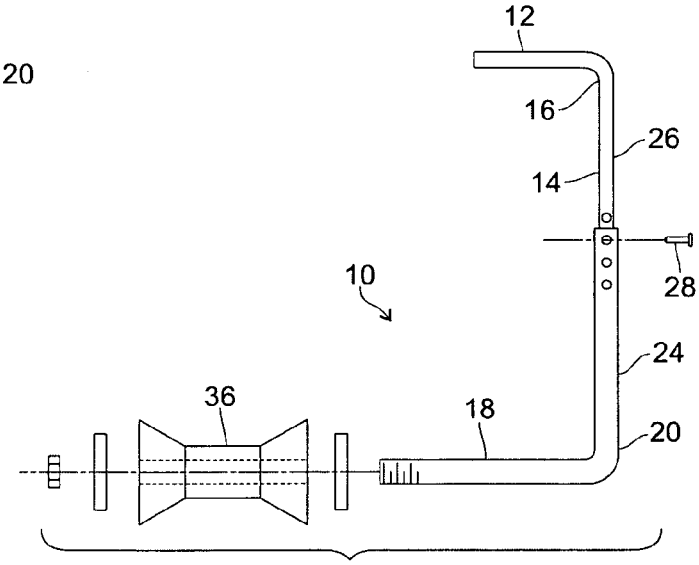
FIG. 3 is a blow-up view of the lift of FIG. 2.
Figure 4:
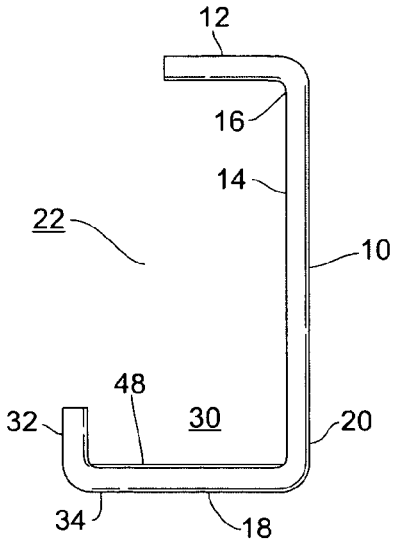
FIG. 4 is a side view of an alternate embodiment of the personal fuel hose lift showing a lubric surface on the fuel line support.

The fuel hose lift 10 of the present invention is a personal tool for ergonomically lifting a portion of a fuel hose 100, typical of a fuel hose connected between a tanker truck valve 102 and an underground storage tank port 104 for delivering fuel to the storage tank 106. The lift 10 comprises a handle 12 adapted for a user to hold while lifting a fuel hose 100 within the lift 10, a bar 14 depending from the handle 12 on a bar first end 16, and a fuel hose support 18 on a bar second, or distal, end 20 mechanically connecting the handle 12 and the support 18. The support 18, handle 12 and bar 14 generally form a C-shape with on open portion 22 sized to receive a fuel hose 100 therethrough into the lift 10 intermediate the fuel hose 100.

The bar 14 is of length such that lift 10 hanging from a user's downward extended arm 108 lifts a fuel hose portion 110 above ground 112 as the user walks in erect posture along the fuel hose lifting successive fuel hose portions in progressively draining residual fuel out of the fuel hose. The bar 14 can be of adjustable length, comprising a first inner member 24 telescoping from a second outer member 26 and secured by a locking pin 28. Typically, the bar 14 is adjusted to the user's height such that the fuel hose portion 110 is lifted a distance from the ground equal to its diameter when the lift hangs from the user's straight arm reaching downward.

In the primary embodiment, the support 18 includes a trough 30 opposite the handle 12 and sized to receive the fuel hose 100 from the lift open portion 22. The trough 30 further comprises a support distal portion 32 directed upward from a support lower portion 34 to the lift open portion 22. The support 18 is adapted to move along the fuel hose 100 lifting portions of a fuel hose progressively along the line causing residual fuel to drain by gravity away from successively raised portions and out of the fuel hose.

In the primary embodiment, a roller 36 is disposed rollably on the support 18 on which the fuel hose 100 rests to facilitate movement of the lift 10 along the fuel hose 100. First and second circumferential raised flanges 40 and 42 are on roller distal and proximal ends 44 and 46, that is, opposite and adjacent the bar 14, respectively, forming the trough 30 and supporting the fuel hose 100 between the flanges 40, 42 central in the trough 30, the second circumferential raised flange 42 comprising the upwardly direction distal portion 32. Typically, the handle 12, support 18 and roller 36 are horizontal and the bar is vertical. In an alternate embodiment, the support 18 comprises a lubric outer surface 48 facilitating sliding of the support 18 along the fuel hose 100.

Having described the invention, what is claimed is as follows:

1. A personal fuel hose lift adapted as a personal tool for ergonomically lifting a portion of a fuel hose, comprising a handle adapted for a user to hold while lifting a fuel hose within the lift, a bar depending from the handle on a bar first end, a fuel hose support on a bar second, or distal, end separating the handle from the support, the support, handle and bar generally in C-shape with an upwardly open portion opposite the bar and sized to receive a fuel hose therethrough into the lift intermediate the fuel hose, the support including a trough opposite the handle, the trough sized to receive the fuel hose from the lift open portion and adapted to slide along the fuel hose lifting portions of a fuel hose progressively along the line causing residual fuel to drain by gravity away from successively raised portions and out of the fuel hose.

2. The personal fuel hose lift of claim 1 wherein the trough further comprises a support distal portion directed upward from a support lower portion to the lift open portion.

3. A personal fuel hose lift adapted as a personal tool for ergonomically lifting a portion of a fuel hose, comprising a handle adapted for a user to hold while lifting a fuel hose within the lift, a bar depending from the handle on a bar first end, a fuel hose support on a bar second, or distal, end separating the handle from the support, the support, handle and bar generally in C-shape with on open portion sized to receive a fuel hose therethrough into the lift intermediate the fuel hose, the support including a trough opposite the handle, the trough sized to receive the fuel hose from the lift open portion and adapted to slide along the fuel hose lifting portions of a fuel hose progressively along the line causing residual fuel to drain by gravity away from successively raised portions and out of the fuel hose, and a roller on the support on which the fuel hose rests in the trough.

4. The personal fuel hose lift of claim 3 wherein the trough comprises the roller with a first circumferential raised flange about its distal end.

5. The personal fuel hose lift of claim 4 wherein the roller further includes a second circumferential raised flange about its proximal end adjacent the bar supporting the fuel hose therein central in the trough, the trough defined between the roller first and second circumferential raised flanges.

6. The personal fuel hose lift of claim 4 wherein the handle, support and roller are horizontal and the bar is vertical.

7. The personal fuel hose lift of claim 1 wherein the support comprises a lubric outer surface facilitating sliding of the support along the fuel hose.

8. A personal fuel hose lift adapted as a personal tool for ergonomically lifting a portion of a fuel hose, comprising a handle adapted for a user to hold while lifting a fuel hose within the lift, a bar depending from the handle on a bar first end, a fuel hose support on a bar second, or distal, end separating the handle from the support, the support, handle and bar generally in C-shape with on open portion sized to receive a fuel hose therethrough into the lift intermediate the fuel hose, the support including a trough opposite the handle, the trough sized to receive the fuel hose from the lift open portion and adapted to slide along the fuel hose lifting portions of a fuel hose progressively along the line causing residual fuel to drain by gravity away from successively raised portions and out of the fuel hose, wherein the bar is of length such that as the user walks in erect posture along the fuel hose with the fuel hose in the lift, the user with the lift hanging from the user's downward extended arm lifts the fuel hose in successive portions progressively draining residual fuel out of the fuel hose.

9. The personal fuel hose lift of claim 8 wherein the bar is of length such that the fuel hose portion is lifted a distance from the ground equal to its diameter.

10. The personal fuel hose lift of claim 8 wherein the bar is adjustable in length comprising a first inner member telescoping from a second outer member and secured at a preferred relative position by a locking pin, adjusted to the user such that the fuel hose portion in the lift trough is lifted a distance from the ground when the lift hangs from the user's straight arm reaching downward.

11. The method of draining residual fuel from a fuel hose connected to a fuel delivery truck to deliver fuel from the truck to an underground storage employing a lift having a handle adapted for a user to hold while lifting a fuel hose within the lift, a bar depending from the handle on a bar first end, and a fuel hose support on a bar second, or distal, end separating the handle from the support, the support, handle and bar generally in C-shape with an open portion sized to receive a fuel hose therethrough into the lift intermediate the fuel hose, the support including a trough opposite the handle, comprising the following steps:

(a) placing the hose over the trough, the hose entering the lift through the lift open portion near the truck at the truck tank valve;

(b) grasping the handle to allow the lift to move vertical of its own weight over the hose;

(c) guiding the hose into the lift trough as the user;

(d) walking in erect posture from the truck along the fuel hose with the lift hanging from the user's downwardly extending arm, the lift sized to engage the hose in its trough at a hose engagement level several inches above the ground, the lift lifting the fuel hose progressively along the fuel hose urging fuel in the hose to move forward of the lift by gravity while hose portions rearward of the lift fall to the ground empty of fuel.

* * * * *